US005164198A

United States Patent [19]

Bauckhage et al.

[11] Patent Number: 5,164,198

[45] Date of Patent: Nov. 17, 1992

[54] APPARATUS FOR PULVERIZING AT LEAST ONE JET OF MOLTEN METAL

[75] Inventors: Klaus Bauckhage; Norbert Kunert; Peter Schreckenberg; Hermann Vetters, all of Bremen, Fed. Rep. of Germany

[73] Assignee: Branson Ultaschall Niederlassung der Emerson Technologies GmbH & Co., Fed. Rep. of Germany

[21] Appl. No.: 551,041

[22] Filed: Jul. 11, 1990

Related U.S. Application Data

[63] Continuation of Ser. No. 246,856, Sep. 20, 1988, abandoned.

[30] Foreign Application Priority Data

Sep. 22, 1987 [DE] Fed. Rep. of Germany ..... 3731866
Oct. 10, 1987 [DE] Fed. Rep. of Germany ..... 3735787

[51] Int. Cl.[5] ..... B05B 17/06; B22F 9/06

[52] U.S. Cl. ..... 425/6; 264/9; 264/12; 425/7; 425/174.2

[58] Field of Search ..... 425/6, 7, 174, 174.2; 264/5-10, 22, 23, 12; 75/335, 336, 337, 338, 339

[56] References Cited

U.S. PATENT DOCUMENTS

| | | | |
|---|---|---|---|
| 3,397,258 | 8/1968 | Williams | 264/23 |
| 4,233,007 | 11/1980 | Karlsson | 425/7 |
| 4,533,376 | 8/1985 | Muschelknautz et al. | 65/5 |
| 4,534,917 | 8/1985 | Walz | 264/12 |
| 4,553,917 | 11/1985 | Lee | 425/6 |
| 4,767,492 | 8/1988 | Fukusima et al. | 425/174.2 |
| 4,795,330 | 1/1989 | Noakes et al. | 425/6 |

FOREIGN PATENT DOCUMENTS

| | | | |
|---|---|---|---|
| 42903 | 1/1982 | European Pat. Off. . | |
| 217518 | 4/1984 | European Pat. Off. . | |
| 173435 | 3/1986 | European Pat. Off. . | |
| 2656330 | 3/1984 | Fed. Rep. of Germany . | |
| 2842232 | 4/1985 | Fed. Rep. of Germany . | |
| 51-46546 | 12/1976 | Japan | 425/174.2 |
| 2098498 | 11/1982 | United Kingdom . | |

*Primary Examiner*—Jay H. Woo
*Assistant Examiner*—Khanh P. Nguyen
*Attorney, Agent, or Firm*—Harness, Dickey & Pierce

[57] ABSTRACT

An apparatus for pulverizing as least a jet of liquid material, preferrably molten metal. The pulverizing capacity is increased by disposing a plurality of ultrasonic actuators to generate a superimposed ultrasonic field having a very high energy density in at least one nodal area. The liquid material is pulverized in a pressurized gaseous fluid to induce an increased energy transfer for the ultrasonic energy.

14 Claims, 4 Drawing Sheets

APPARATUS FOR PULVERIZING AT LEAST ONE JET OF MOLTEN METAL

This is a continuation of U.S. patent application Ser. No. 246,856, filed Sept. 20, 1988, now abandoned.

BACKGROUND OF THE INVENTION

The invention refers to a method for pulverizing at least a jet of a liquid material preferrably molten and an apparatus for performing the method.

According to prior art known devices disclosed in German applications 3112339, 3112340, 3518646 and German petty patent 8807489 provide an ultrasonic generator to vibrate a flexible electrode. A liquid applied to the electrode is thus nebulized.

According to German patent 2656330 and 2842232 a standing ultrasonic field is generated between an ultrasonic actuator and a reflector. Molten metal emerging from a melting container is pulverized in the ultrasonic field. The ultrasonic capacity obtained by the known devices is rather limited. Further, the relatively small ultrasonic power in pulverizing leads to a low quenching rate of the molten metal after pulverizing resulting in granular sizes and characteristics to be avoided.

A principal object of the invention is, therefore, to provide a method and an apparatus for increasing the pulverizing capacity. It is a further object to provide an improved quenching of the metallic particles pulverized.

In the present invention the higher energy transfer from the ultrasonic field to the particles to be pulverized is accomplished by generating the ultrasonic field in a pressurized fluid. The pulverizing power is substantially increased by the higher energy density of the ultrasonic field. In addition the metallic particles pulverized are more rapidly quenched in the ultrasonic field of higher energy since they receive a larger impulse or impetus resulting in a "slip" between the fluid and the high speed-metallic particles.

According to a further aspect of the present invention the particles pulverized are compacted immediately after pulverizing and quenching to manufacture a workpiece. To accomplish this metallic particles having super plastic characteristics after being quenched are blasted onto a substrate on which the individual particles are welded together. The blasting takes place preferably under pressure. Compacting is preferrably accomplished when the particles have obtained a stable state after being pulverized and are quenched so far that the microstructure is not changed anymore, but the particles are still hot enough for welding.

According to a principal aspect of the present invention the ultrasonic field is generated in the space between at least a pair of ultrasonic actuators. To further increase the pulverizing capacity, further pairs of actuators may be provided to generate an ultrasonic field having one or more nodal areas. The molten metal is preferrably directed through at least one of said nodal areas, greatly increasing the pulverizing capacity by the superimposing of the ultrasonic fields generated by said pairs of actuators.

Further another aspect of this invention will be more readily apparent when the following specification is reas in conjunction with the accompanying drawings.

The apparatus shown is used to pulverize a jet of liquid metal in making tools, semi-finished products and parts of metallic powder.

Figure 1:
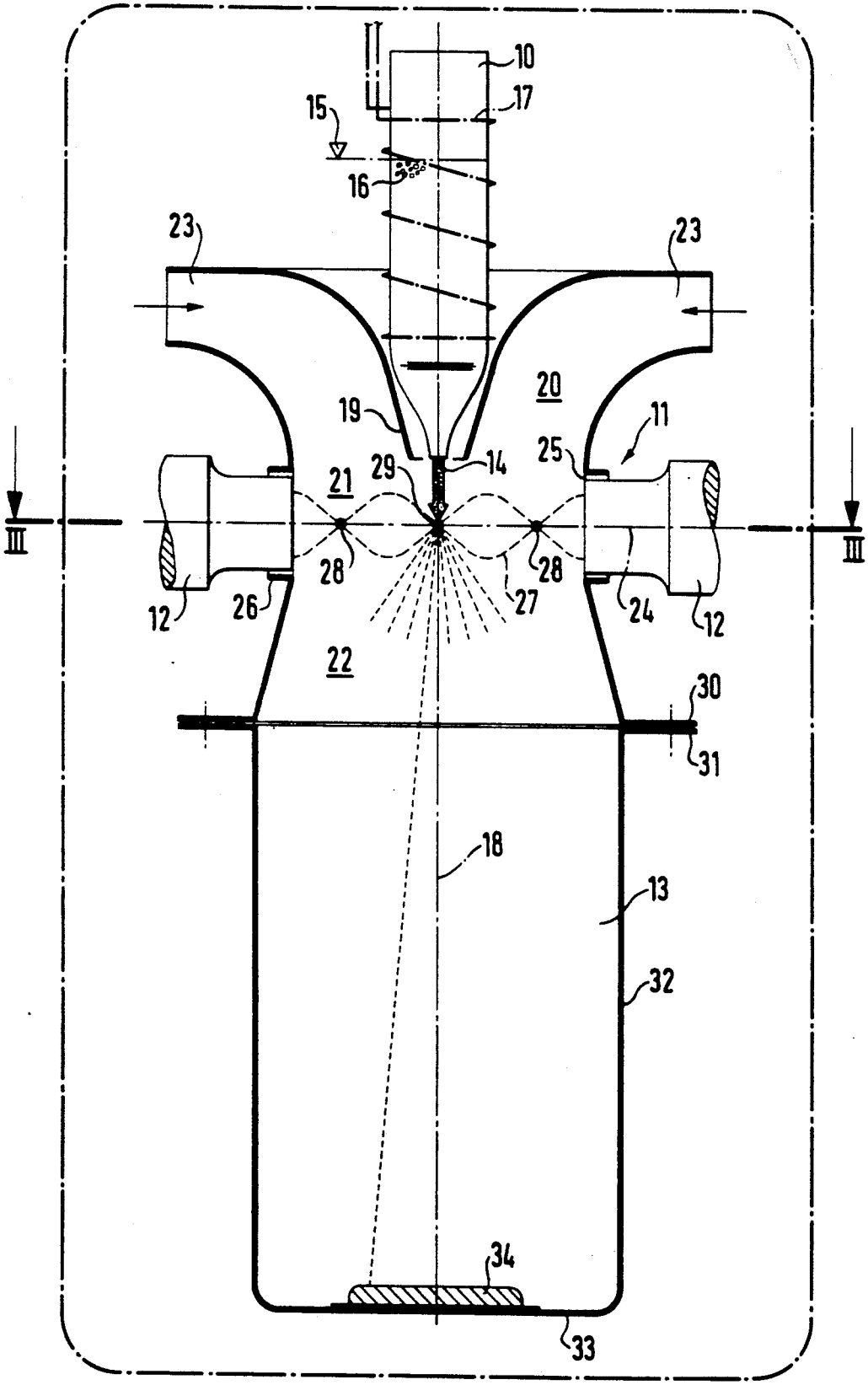
FIG. 1 is a vertical section of a first embodiment.

As shown in FIG. 1, there is a pot or crucible 10 opening into a nozzle 11, further a pair of ultrasonic generators 12 followed by a pressure container 13. Crucible 10 at the top of the apparatus is bottle-shaped including a downwardly extending tapering opening 14. The crucible 10 is filled with the raw material up to the height 15 which raw material is to be molten and then blasted and consists of a powderized or particulate metallic granulate 16. A heater winding 17 around the crucible 10 allows to melt the granulate 16 to a temperature above the liquid point.

The central opening 14 of the crucible 10 opens into an upright entering funnel 19 of the nozzle 11. The nozzle is substantially shaped as a Laval nozzle. Accordingly, the nozzle comprises an upper accelerating section 20 tapering along a peripheral arc, followed by a throttle section 21 which opens into a truncated conic exit section 22.

A gas inlet channel opens laterally into the upper portion of the accelerating section 20. In the present embodiment the gas inlet is shaped as a radially surrounding annular channel 23. A gaseous fluid, preferrably an inert or reaction gas cooled down below room temperature is applied through the channel 23 under pressure to the apparatus.

Both ultrasonic generators 12 are provided opposite each other in the central throttle section 21 of the nozzle 11.

More accurate the generators are provided along a common, horizontal longitudinal axis 24 intersecting the central vertical axis 18 of the device. The forward portions of the generators 12 extend through openings 25 into the throttle section 21. To facilitate this mounting the openings 25 each are provided with a collar 26. The ultrasonic generators are mounted separately in a manner not shown, but external of the front heads of the generators 12. The mounting is decoupled with respect to oscillations.

The relative position of the oscillating axis 24 with respect to the individual sections of the nozzle 11 is selected such that the oscillating axis 24 is located somewhat above the throttle section 21 and substantially within the endportion of the accelerating section 20.

Both ultrasonic oscillators 12 are identical, in particular with respect to power, frequency and amplitudes. Accordingly, the oscillators generate identical superimposed ultrasonic fields 27 of approximately 20 kHz at an oscillating power of 250 up to 3000 W. In the embodiment shown both generators 12 are located in a distance of 6 quarter wave length, wherein three nodal areas 28 and 29 are defined, of which the central nodal area 29 disposed on the generator axis 24 and the central axis 18 is used to pulverize the jet of molten material exiting from the crucible 10.

As further shown in FIG. 1 the lower edge of the nozzle 11 is provided with an annular flange 30 to which a corresponding flange 31 of the pressure container 13 may be removably mounted.

As shown the pressure container comprises a cylindrical body 32 and a plane horizontal bottom 33. The bottom 33 supports a substrate plate 34 receiving the pulverized particles, preferrably for compacting.

Figure 2:
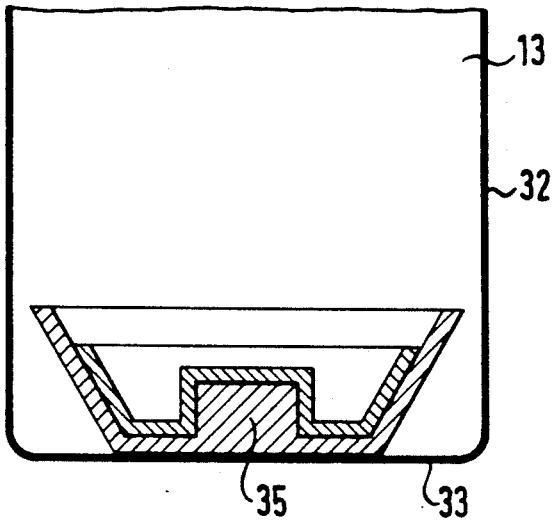
FIG. 2 schematically shows a die in the lower portion of a pressure container.

FIG. 2 shows a negative die 35 supported on the bottom 33 of the pressure container 13. In this manner finished parts of any desired shape may be made by a compacting step while the metallic particles are in super plastic state. Preferrably, rotationally symmetrical parts may be manufactured. The die 35 can be continuously rotated around a vertical axis by a suitable drive means to obtain a substantially uniform thickness.

In an alternative embodiment the pressure container can be made large enough to completely accomodate the crucible 10, the nozzle 11 and the ultrasonic oscillators 12, for example pending below a lid closing the pressure container. The alternate embodiment of the pressure container is shown in dash-dot lines in FIG. 1.

Figure 3:
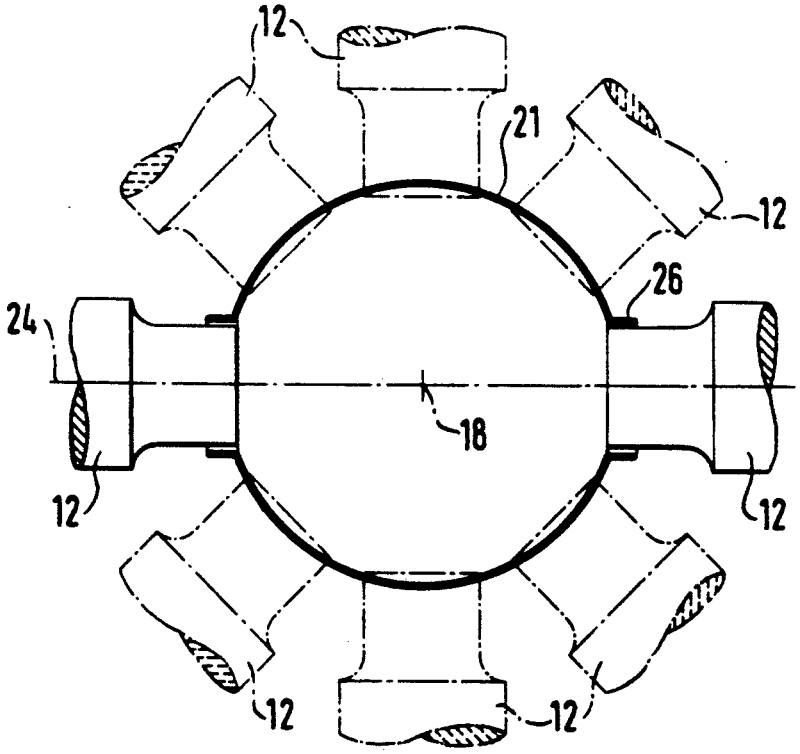
FIG. 3 is a horizontal section along lines III—III in FIG. 1.

FIG. 3 shows a further embodiment for providing a plurality of ultrasonic generators 12 such that a plurality of pairs of generators 12 each opposite each other are provided for further increasing the power. More particular FIG. 3 shows three further generator pairs illustrated in dash-dot lines in addition to the generator pair previously shown. All oscillating axes 24 are located in a common horizontal plane for generating further ultrasonic fields all of which intersecting the central nodal area 29 on the longitudinal axis 18 of the device.

The embodiment shown allows a very high pulverizing capacity and a particular high quenching rate since a high energy density in the nodal area 29 is generated by the plurality of generators 12 all generating an identical ultrasonic field 27. Furthermore, the ultrasonic wave 27 is generated in a densified gaseous fluid of high energy transfer characteristics. It is within the scope of the invention to pulverize material by using at least a pair of generators in the configuration disclosed in combination with a gaseous fluid under atmospheric pressure while eliminating the pressure container 13 or to use the configuration of generators in combination with a pressurized gaseous fluid. However, even providing a single ultrasonic generator according to prior art devices could be advantageously used in the pressure container shown.

The device of FIG. 1 is used as follows: The granulate heated by the winding 17 is fed through the opening 14 of the pot 10 as a liquid jet into the accelerating section 20 of the nozzle 11 where it is pulverized in the nodal area 29 by the ultrasonic wave 27 before reaching the throttle section 21. The accelerating of the metallic particles by the pulverizing step and subsequently by the further tapering of the nozzle 11 in the throttle section 21 results in a "slip" of the particles in the gaseous fluid. This results in a rapid quenching of the particles. According to the invention the rapid quenching is further increased by pulverizing in a pressurized gaseous fluid resulting in an increased amount of energy to be produced by the ultrasonic wave 27. In addition the inert pressurized gas (nitrogene) or reaction gas (hydrogene) which may have a temperature down to −200° C. is applied to the nozzle 10 through the annular channel 23.

The metallic powders pulverized and quenched rapidly consist of very small, mostly globular grains (<0.1 μm) which are cooled so far that no microstructural change takes place anymore, but allowing a welding of the grains by using its superplastic characteristics when being compacted on the substrate 34 or in the die 35 supported on the bottom 33 of the pressure container 13.

Figure 4:
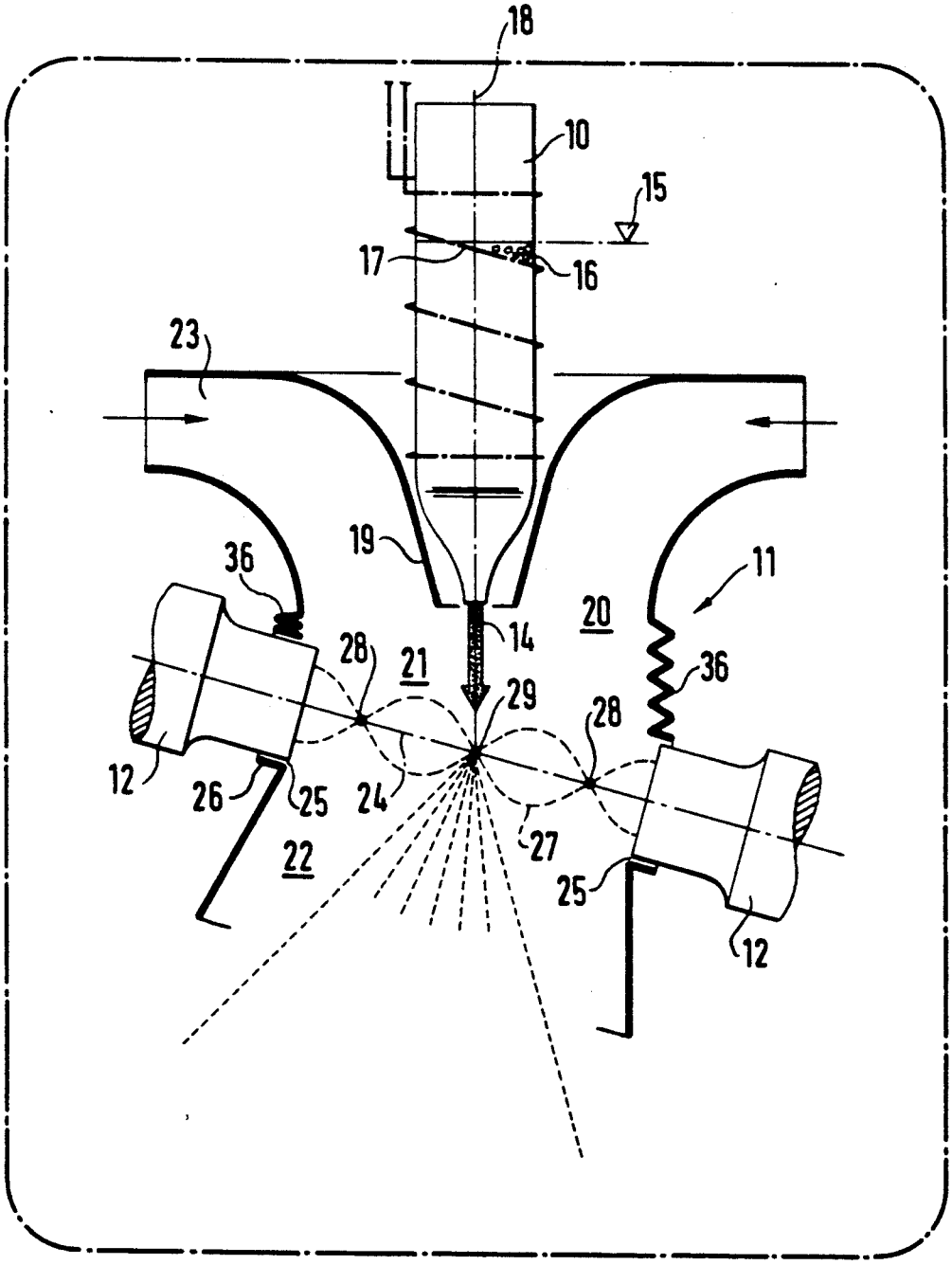
FIG. 4 is a part section of a further embodiment.

FIG. 4 shows a further embodiment of the invention according to which the ultrasonic oscillators 12 are located in a different position with respect to the nozzle 11. The generators are disposed at equal angles but in opposite directions with respect to the nozzle 11 such that the oscillating axis 24 is under an angle of the horizontal. Accordingly, the pulverized particles are deflected after reaching the nodal area 29 with respect to the longitudinal axis 18 towards a direction deviating from the vertical. The cone of pulverized metallic particles originating in the nodal area 29 is thus deflected from the longitudinal central axis 18.

It is further possible to displace the generators 12 along the oscillator axis 24 while maintaining the distance therebetween, whereby the nodal area 29 is exactly aligned with the central axis 18 to align the nodal area 29 and the jet of liquid metal leaving the pot 10. Furthermore, deviations of the position of the nodal area 29 between the generators 12 may be compensated so that the nodal area 29 is again hit by the jet. To accomplish this the generators 12 are either fully or partly located in a section of the nozzle 11 defined to be a bellows 36. In the embodiment shown the upper portion of the generators 12 cooperate with a bellows 36 which define the accelerating section 20 or, respectively, the throttle section 21 of the nozzle 11. The lower portion of the generators 12 cooperates with a fixed section of the nozzle 11 such as the exit section 22 which may be pivoted together with the generators 12.

Figure 5:
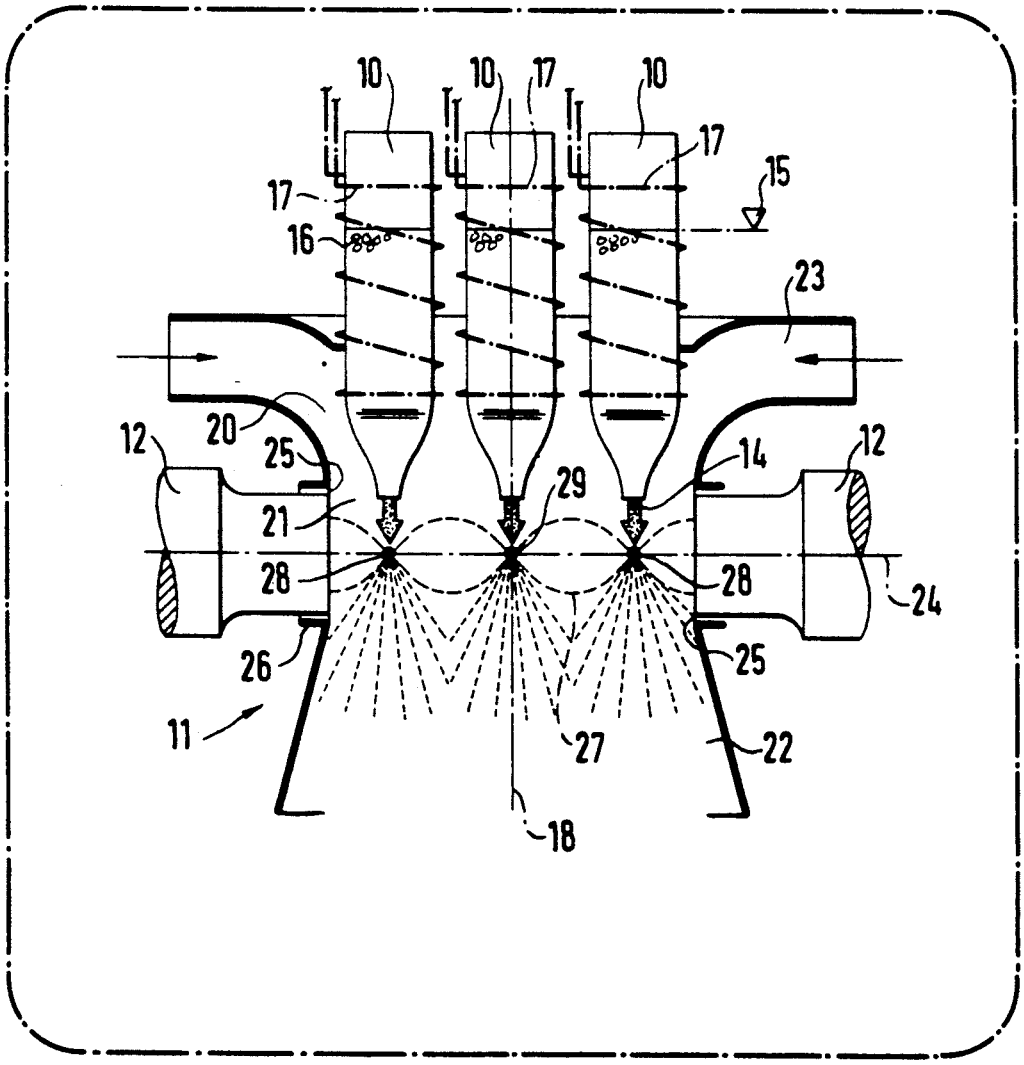
FIG. 5 is a part section of a third embodiment of the invention.

A further embodiment is shown in FIG. 5 according to which three crucibles 10 preferrably located adjacent each other in a common vertical plane are provided for a nozzle 11. The distance between the three crucibles 10 is selected such that the three jets emerging therefrom are directed each to one of the three nodal areas 28 and 29 of the ultrasonic field 27. This device allows for a particular high pulverizing capacity as all nodal areas 28 and 29 of the ultrasonic field 27 are used to pulverize the liquid metal.

We claim:

1. An apparatus for pulverizing a jet of liquid molten metal comprising a container for molten metal, said container having discharge port for discharging the jet of molten metal; a discharge passage through which the jet of molten metal passes after exiting the container, said passage comprising a nozzle defining a restricted throat area; and a pair of ultrasonic devices spaced around said throat area for generating an ultrasonic field therebetween defining at least one nodal point of maximum energy density, said discharge port, discharge passage and pair of ultrasonic devices relatively positioned such that the jet of molten metal passes through said nodal point of maximum energy density to pulverize the jet of molten metal.

2. The apparatus of claim 1 wherein the pair of ultrasonic devices are located so as to define a common oscillator axis along which the nodal point lies.

3. The device of claim 1, wherein the ultrasonic actuators have identical power characteristics.

4. The apparatus of claim 1, wherein said ultrasonic devices are located within the smallest cross-sectional area of said nozzle.

5. The apparatus of claim 1, wherein the nozzle is shaped as a Laval nozzle.

6. The apparatus of claim 1, wherein an annular gas inlet opens into said nozzle.

7. The apparatus of claim 6, wherein the gas inlet is an annular channel opening into the inlet of said nozzle.

8. The apparatus of claim 7, wherein the discharge passage opens into pressure container.

9. The apparatus of claim 8, wherein at least the ultrasonic devices, the discharge passage and the metal container are provided within said pressure container.

10. The apparatus of claim 8, wherein the pressure container accomodates means for depositing metallic particles pulverized.

11. The apparatus of claim 1, wherein a plurality of pairs of ultrasonic devices are provided around said discharge passage and ultrasonic fields are provided along oscillator axes between each pair of ultrasonic devices, the oscillator axes intersecting each other at a common nodal point corresponding to the nodal point of each ultrasonic field through which the molten metal passes.

12. The apparatus of claim 1, wherein the ultrasonic field of the pair of ultrasonic devices has a plurality of nodal points.

13. The apparatus of claim 12, wherein a separate container having a discharge port is provided for each nodal point to provide a separate jet of molten metal at each nodal point.

14. The apparatus of claim 1, further comprising an adjustable mounting means for said pair of ultrasonic devices enabling adjustment of the ultrasonic field to intersect a central longitudinal axis of the discharge passage at varying angles including an angle of 90°.

* * * * *

UNITED STATES PATENT AND TRADEMARK OFFICE

CERTIFICATE OF CORRECTION

PATENT NO. : 5,164,198

DATED : November 17, 1992

INVENTOR(S) : Bauckhage et al

It is certified that error appears in the above-identified patent and that said Letters Patent is hereby corrected as shown below:

Column 5, line 3, Claim 8, "7" should be --1--.

Column 5, line 4, Claim 8, after "into" insert --a--.

Signed and Sealed this

Sixteenth Day of November, 1993

*Attest:*

*Attesting Officer*

Bruce Lehman

BRUCE LEHMAN

*Commissioner of Patents and Trademarks*